US005555655A

United States Patent [19]

Yager et al.

[11] Patent Number: 5,555,655

[45] Date of Patent: Sep. 17, 1996

[54] IDENTIFICATION DEVICE FOR A CONTAINER

[75] Inventors: John Yager, North Royalton; Bernard Lozar, Broadview Heights, both of Ohio; Milton L. Klein, Crown Point, Ind.

[73] Assignee: AGA AB, Lidingo, Sweden

[21] Appl. No.: 311,961

[22] Filed: Sep. 26, 1994

[51] Int. Cl.[6] ..... G09F 3/08

[52] U.S. Cl. ..... 40/306; 40/665

[58] Field of Search ..... 40/306, 307, 310, 40/311, 316, 665

[56] References Cited

U.S. PATENT DOCUMENTS

| | | | |
|---|---|---|---|
| 1,796,398 | 3/1931 | Richardson | 40/665 X |
| 2,177,359 | 10/1939 | Baker | 40/306 X |
| 2,613,462 | 10/1952 | Johnson | 40/307 |
| 2,703,546 | 3/1955 | Allen | 40/306 X |
| 3,831,300 | 8/1974 | Berkhouse | 40/310 |
| 4,640,031 | 2/1987 | Hoek et al. | 40/306 |
| 4,827,643 | 5/1989 | Hearst et al. | 40/306 |

*Primary Examiner*—Joanne Silbermann

*Attorney, Agent, or Firm*—Pearne, Gordon, McCoy & Granger

[57] ABSTRACT

A neck ring has inwardly projecting fingers for engaging a threaded neck of a gas cylinder. The fingers are flexible and sloped upwardly to securely hold the neck ring on the cylinder while permitting removal without damaging the neck ring. Identification labels are mounted on flat, translucent or opaque tags. The separate tags are hinged and spaced apart to accommodate differently configured cylinders.

19 Claims, 3 Drawing Sheets

Fig.1
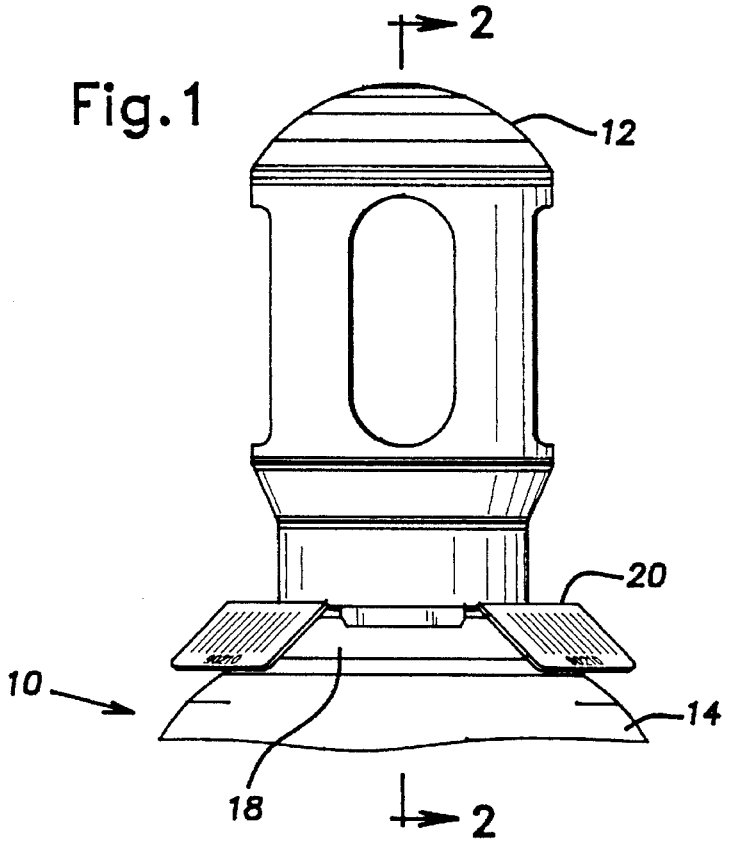
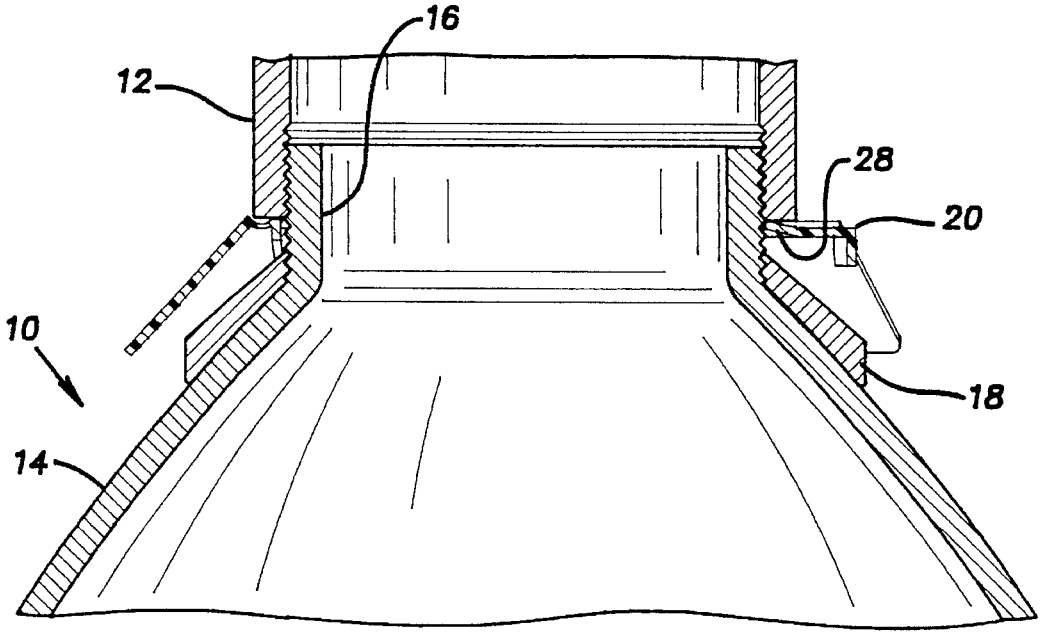
Fig.2

IDENTIFICATION DEVICE FOR A CONTAINER

BACKGROUND OF THE INVENTION

1. Field of the Invention

This invention relates generally to the field of gas cylinders and specifically to an improved identification device therefor.

2. Description of the Related Art

Many industries employ reusable containers for transporting and dispensing consumable products. These containers generally are expensive and are subjected to a wide variety of environmental conditions during transportation and use. Containers used to store pressurized gas, such as oxygen, acetylene, nitrogen and the like are particularly common. Such containers are commonly referred to as "cylinders" or "gas cylinders," and those terms will be used hereafter to describe one particular type of container for which the invention has applicability.

In many applications, it is necessary to be able to identify each individual cylinder by its serial number or other identifying information such as cylinder type, weight or contents. For convenience, such identifying information will be referred to hereafter as "cylinder data." The identification of cylinder data is a particular problem in the industrial gas industry wherein it is desirable to have cylinder data affixed to each cylinder in an encoded form to facilitate automatic reading of the cylinder data for input to a computerized inventory control system.

Previously, markings have been applied directly to the cylinder. However, these are subject to wear, damage, or obliteration. Identification markings have also been provided on a neck ring fitting over the neck of the cylinder. The neck ring encircles the neck and provides a curved surface on which the cylinder data are located. Such neck rings are shown in U.S. Pat. No. 4,827,643, incorporated herein by reference. Although these neck rings were a great improvement over the then existing art, the desire for further improvements exists.

SUMMARY OF THE INVENTION

The present invention provides an identification device for a container, such as a gas cylinder, having a threaded neck. A body mountable on the neck has fingers extending inwardly therefrom that are adapted to engage the neck. A tag is attached to the body, and an identification label is mounted on the tag.

The fingers are flexible, upwardly sloped, and include a hinge. The fingers are symmetrically spaced and extend past an inner edge of the body.

The tag is translucent or opaque, generally rectangular, and attached on an outer edge of the body. The label is located on a flat face of the tag. The tag is attached to the body by a hinge and slopes downwardly and outwardly from the body.

Preferably the body comprises a ring disposable around the neck and has a plurality of separate tags attached to the body, each tag having a label disposed thereon. The body, fingers, and tag are a one-piece molded structure made of polypropylene.

The flat tags provide improved accuracy for machine read labels, particularly where the labels are especially long. The separate, hinged tags allow the neck ring to be mounted on containers having differently shaped bodies near the neck and provide space for access and clearance for protrusions near the neck. The flexible fingers allow easier installation and removal, while securely engaging the neck to prevent inadvertent removal. The material of the neck ring, particularly the flexible fingers, reduce the likelihood of breaking the neck ring during removal and during handling of the cylinder. The translucent tags improve readability of the labels.

BRIEF DESCRIPTION OF THE DRAWINGS

FIG. 1 shows a side elevational view of a top part of a gas cylinder having an identification device of a type preferred for high pressure cylinders according to the present invention installed thereon;

FIG. 2 shows a sectional view of the gas cylinder taken from line 2—2 of FIG. 1;

DESCRIPTION OF THE PREFERRED EMBODIMENTS

Figure 3:
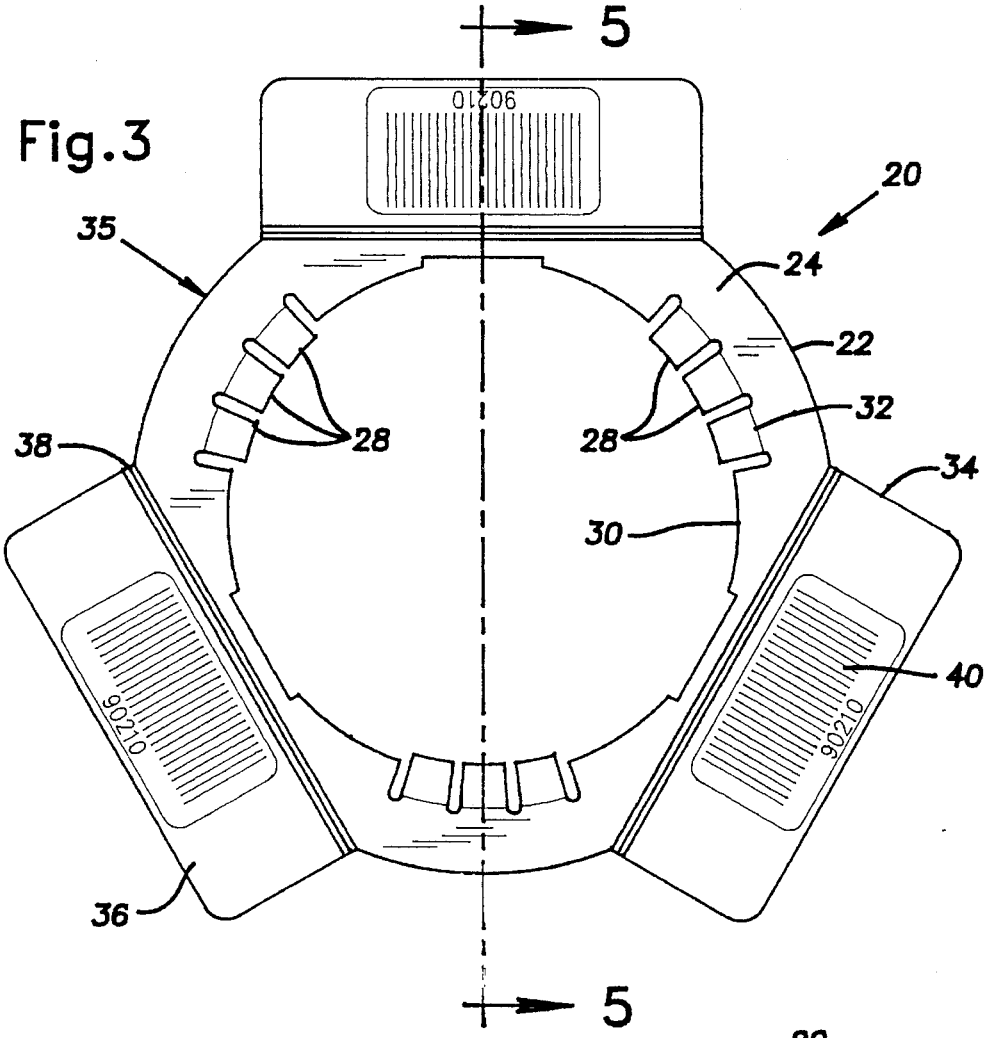
FIG. 3 shows a top view of the identification device.

Referring to FIG. 1, a pressurized gas cylinder 10 is provided with a cap 12 that covers and protects a valve (not shown). The valve controls flow of material into and out of the cylinder 10. The cylinder 10 has an elongated, generally cylindrical body 14. Ends of the body 14 are curved inwardly. The cylinder 10 is made with generally rigid material, such as steel.

As shown in FIG. 2, the upper end of the cylinder 10 is provided with a threaded neck 16. A protective collar 18 is located at the joinder of the body 14 and the neck 16. An identification device, such as a neck ring 20, is provided around the neck 16 above the collar 18. The cap 12 is threaded onto the neck 16 to clamp the neck ring 20 between the cap 12 and the collar 18.

Figure 4:
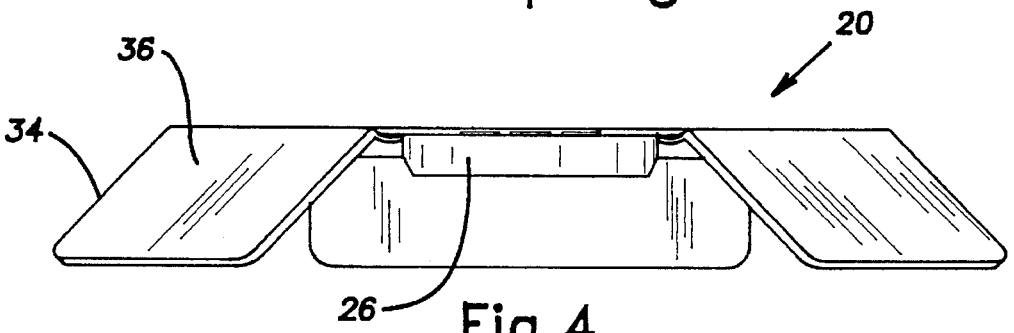
FIG. 4 shows a side view of the identification device.
Figure 5:
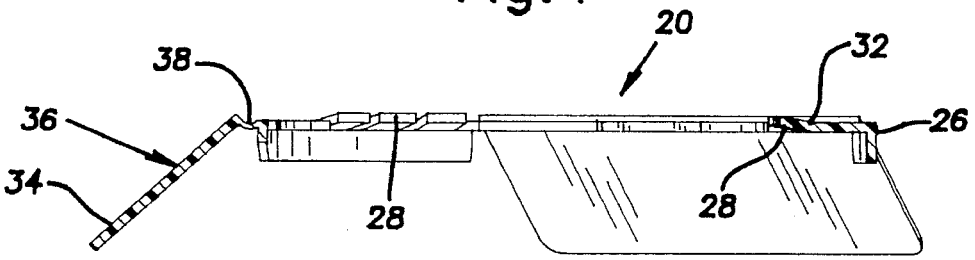
FIG. 5 shows a sectional view of the identification device taken from line 5—5 of FIG. 3.

Referring to FIGS. 3, 4, and 5, the neck ring 20 has a generally circular neck ring body 22 having a base ring 24 and a circumferential flange 26. A plurality of flexible fingers 28 extend radially inwardly from the top ring 24. Preferably, three sets of three fingers 28 are provided, the sets being spaced about 120° and the fingers being spaced about 12°. The diameter of an inner edge 30 of the top ring 24 is greater than the diameter of the neck 16 to permit passage of the neck 16 therethrough. The fingers extend past an inner edge 30 of the top ring 24 so as to be engageable with the threads of the neck 16 (FIG. 2). As shown best in FIG. 5, the fingers 28 are sloped upwardly at about a 15° angle from horizontal. The angle can be achieved by providing a score line 32 near a base of each finger 28. The score line 32 can be molded or cut into the fingers 28.

A plurality of separate tags 34 are hingedly attached to an outer edge 35 of the neck ring body 22 and extend outwardly and downwardly therefrom. Each tag 34 is generally rectangular and has a flat face 36. The tags 34 are separate from each other and each is attached to the neck ring body 22 along a long edge of the tag by a hinge 38 defined by a flexible member or a score line. The tags 34 are provided with labels 40 having identification information or cylinder data. The labels 40 are preferably self adhesive with a transparent, protective covering. Information is provided on the labels in any suitable format, including machine readable codes or manually readable characters. Alternatively, the label can be readable by other than optical means, such as radio frequency (RF) devices. Preferably, the neck ring 20 is translucent or opaque to improve accuracy when the labels 40 are read.

The neck ring 20 is preferably a single piece of molded polypropylene or other suitable material. As shown, the circumferential flange 26 comprises three sections extending downwardly between the tags 36 for reinforcement of the neck ring 20. The fingers 28 are flexible so that when the neck ring 20 is installed over the neck 16, as shown in FIGS. 1 and 2, the fingers 28 flex upwardly. The flexed fingers 28 press inwardly and engage the threads of the neck 16. Because the fingers 28 are sloped upwardly, they resist upward movement of the neck ring 20, thereby preventing inadvertent removal of the neck ring 20. To remove the neck ring 20, sufficient upward force is applied to move the fingers 28 past a horizontal position to a downwardly sloped position. The neck ring 20 can then be lifted off the neck 16. Alternatively, the neck ring 20 can be rotated onto or off of the threads of the neck 16.

Figure 6:
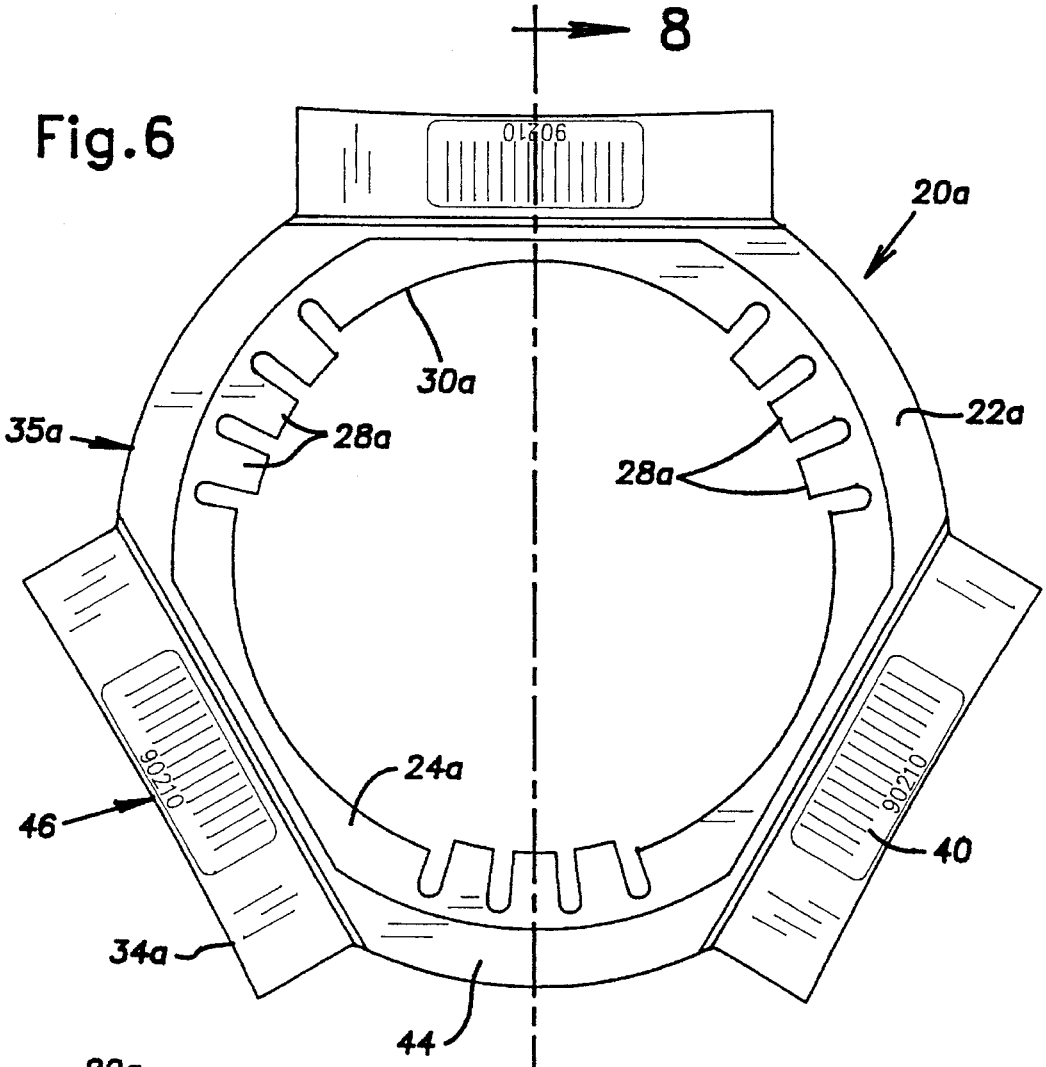
FIG. 6 shows a top view of another embodiment of the identification device preferred for low pressure cylinders.
Figure 7:
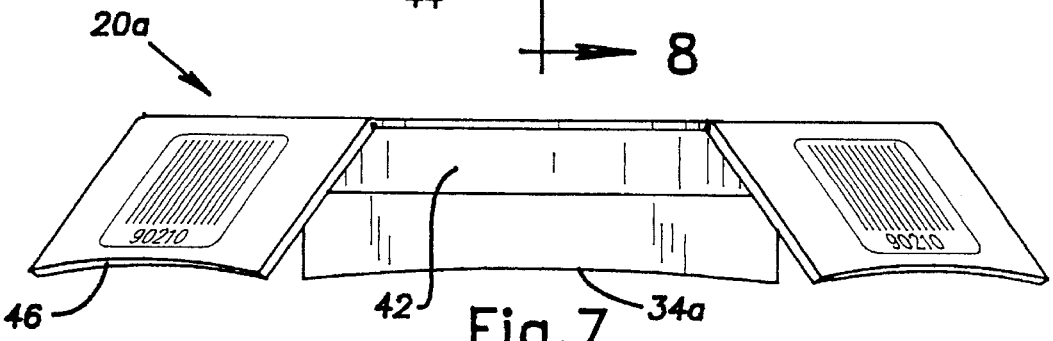
FIG. 7 shows a side view of the identification device of FIG. 6.
Figure 8:
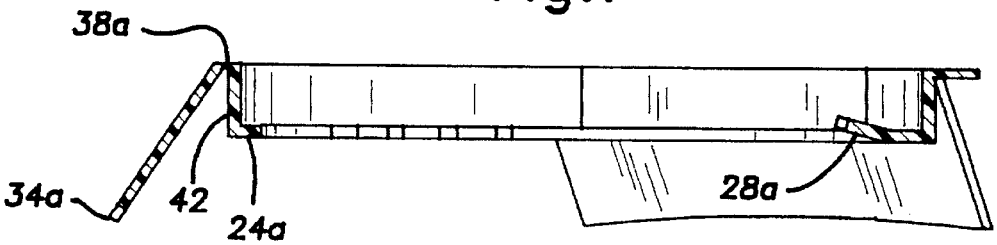
FIG. 8 shows a sectional view of the identification device taken from line 8—8 of FIG. 6.

Referring to FIGS. 6, 7, and 8, another embodiment of the neck ring 20*a* is substantially the same as the first neck ring 20, except as otherwise shown and described. The base ring 24*a* of the body 22*a* has an upstanding flange 42 with a radially outwardly extending rim 44. The fingers 28*a* extend radially inwardly from the base ring 24*a*. The fingers 28*a* are molded with an upward slope, but can have the score line 32 shown in FIG. 3. The fingers 28*a* extend past the inner edge 30*a*. The tags 34*a* are attached to an outer edge 35*a* of the rim 44 by hinges 38*a*. A slightly arcuate edge 46 can be cut in the tag 34*a* to conform to the cylinder body 14. The second neck ring 20*a* is installed on the neck 16 in a manner similar to the first neck ring 20. The second neck ring 20*a* is preferred for low pressure cylinders. The first neck ring 20 is preferred for high pressure cylinders.

Accordingly, a neck ring 20 is disclosed that improves readability and durability over the prior art. The present disclosure describes several embodiments of the invention, however, the invention is not limited to these embodiments. Other variations are contemplated to be within the spirit and scope of the invention and appended claims. The use of such terms as "inwardly" and "downwardly" to describe spatial relationships are intended for convenience only and no particular orientation is to be implied.

What is claimed is:

1. An identification device for a container having a threaded neck, comprising:

a body mountable on the neck and defining an inner edge adapted for fitting around the neck;

fingers having a base attached to the body outside the inner edge, extending inwardly from the body past the inner edge of the body, and adapted to engage threads of the neck;

a tag attached to the body by a flexible hinge, said tag extending outwardly and downwardly from the body prior to installation on the neck; and an identification label on the tag.

2. An identification device according to claim 1, wherein the fingers are flexible.

3. An identification device according to claim 2, wherein each finger includes a hinge.

4. An identification device according to claim 2, wherein the fingers are upwardly sloped prior to installation on the neck.

5. An identification device according to claim 1, wherein the fingers are symmetrically spaced.

6. An identification device according to claim 1, wherein the tag is attached on an outer edge of the body.

7. An identification device according to claim 1, wherein the tag has a flat face on which the label is located, said face facing outwardly and upwardly.

8. An identification device according to claim 1, wherein the tag is generally rectangular.

9. An identification device according to claim 8, wherein the tag is attached to the body along a long edge of the tag.

10. An identification device according to claim 1, wherein the tag is translucent.

11. An identification device according to claim 1, wherein the tag is opaque.

12. An identification device according to claim 1, further comprising a plurality of separate tags attached to the body, each tag having a label disposed thereon.

13. An identification device according to claim 12, wherein the tags are symmetrically spaced around the body.

14. An identification device according to claim 1, wherein the body, fingers, and tag are a one-piece molded structure.

15. An identification device according to claim 14, wherein the molded structure is made of polypropylene.

16. An identification device for a container having a threaded neck, comprising:

a body disposable around the neck and defining an inner edge adapted for fitting around the neck;

fingers having a base attached to the body outside the inner edge, extending inwardly from the body past the inner edge of the body, and adapted to engage threads of the neck;

a plurality of generally rectangular, flat faced tags hingedly attached along an outer edge of the body and sloping downwardly and outwardly from the body prior to installation on the neck; and an identification label on the flat face of at least one of the tags.

17. An identification device for a pressurized gas cylinder having a threaded neck, comprising:

a neck ring body disposable around the neck and having a reinforcing flange extending therefrom;

flexible fingers extending inwardly past an inner edge of the neck ring body and engageable with threads of the neck to retain the neck ring body on the neck;

a plurality of tags hingedly attached to and extending from the neck ring body, said tags having an upwardly and outwardly facing flat surface; and an identification label disposed on the flat surface of each of the tags.

18. A pressurized gas cylinder, comprising:

a cylinder body for containing a pressurized gas therein;

a threaded neck extending from the cylinder body;

a cap threaded on the neck;

a neck ring body having an inner edge disposed around the neck;

a plurality of fingers each having a base attached to the neck ring body outside the inner edge, extending inwardly from the neck ring body past the inner edge, and engaging threads of the neck and captured between the cap and cylinder body;

a tag attached to the neck ring body; and a label disposed on the tag.

19. An identification device for a container having a threaded neck, comprising:

a body mountable on the neck, said body including a ring disposable around the neck and a reinforcing flange extending from the ring;

fingers extending inwardly from the body and adapted to engage threads of the neck;

a tag attached to the body by a flexible hinge, said tag extending outwardly and downwardly from the body prior to installation on the neck; and an identification label on the tag.

* * * * *